United States Patent [19]

Zust et al.

[11] Patent Number: 4,557,539

[45] Date of Patent: Dec. 10, 1985

[54] CONTACT INSERTABLE IN A METALLIZED HOLE OF A PRINTED CIRCUIT CARD AND PROCESS

[76] Inventors: Harry Zust, Weinbergstrasse 58, 8703 Erlenbach; Sigi Burgi, Bohlstrasse 7, 6301 Zug, both of Switzerland

[21] Appl. No.: 632,259

[22] Filed: Jul. 18, 1984

Related U.S. Application Data

[63] Continuation of Ser. No. 296,453, Aug. 26, 1981, abandoned.

[51] Int. Cl.[4] ..... H01R 4/24

[52] U.S. Cl. ..... 339/17 C; 29/845; 339/220 R

[58] Field of Search ..... 411/454; 339/17 C, 95 R, 339/95 A, 220 R

[56] References Cited

U.S. PATENT DOCUMENTS

| | | | |
|---|---|---|---|
| 2,262,499 | 11/1941 | Hunerwadel | 411/454 |
| 2,450,361 | 9/1948 | Scholes | 411/454 |
| 2,946,039 | 7/1960 | Grunwald et al. | 339/95 A |
| 2,998,590 | 8/1961 | Buhrendorf | 339/276 A |
| 3,124,408 | 3/1964 | Oestereicher | 339/220 R |
| 3,252,204 | 5/1966 | McFaddan | 339/275 B |
| 3,348,191 | 10/1967 | Kinkaid | 339/220 R |
| 3,731,261 | 5/1973 | Spadoni, Jr. | 339/276 A |
| 3,923,365 | 12/1975 | Lynch | 339/221 R |
| 4,147,397 | 4/1979 | Iantorno | 339/95 R |
| 4,186,982 | 2/1980 | Cobaugh et al. | 339/221 M |
| 4,325,657 | 4/1982 | Elders | 411/454 |

FOREIGN PATENT DOCUMENTS

| | | | |
|---|---|---|---|
| 690455 | 4/1940 | Fed. Rep. of Germany | 339/220 R |
| 2508532 | 8/1976 | Fed. Rep. of Germany | 339/276 A |
| 1271676 | 8/1961 | France | 339/221 M |
| 41389 | 6/1925 | Norway | 411/454 |
| 22660 | of 1914 | United Kingdom | 411/454 |

*Primary Examiner*—Gil Weidenfeld
*Assistant Examiner*—Gary F. Paumen
*Attorney, Agent, or Firm*—Frishauf, Holtz, Goodman & Woodward

[57] ABSTRACT

Contact insertable in a metallized hole of a printed circuit card containing two ends (1, 2) designed to project on both sides of the card in position of insertion of the contact and to facilitate the electric connection of any devices. The contact includes a median part (3) joining the ends (1, 2) which assures the electrical connection of the contact with the, metallized interior surface of the hole and at the same time its mechanical retention in the hole. The median part (3) comprises a spiral structure of a rectangular section, the verticles of which define the edges (4) of that spiral structure.

14 Claims, 8 Drawing Figures

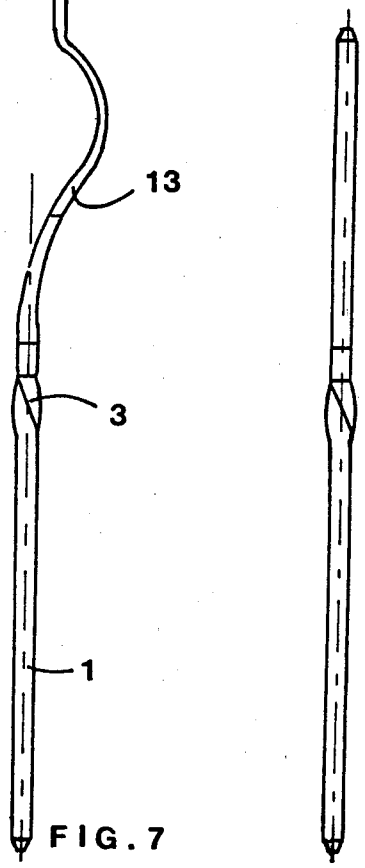
FIG. 8
FIG. 7
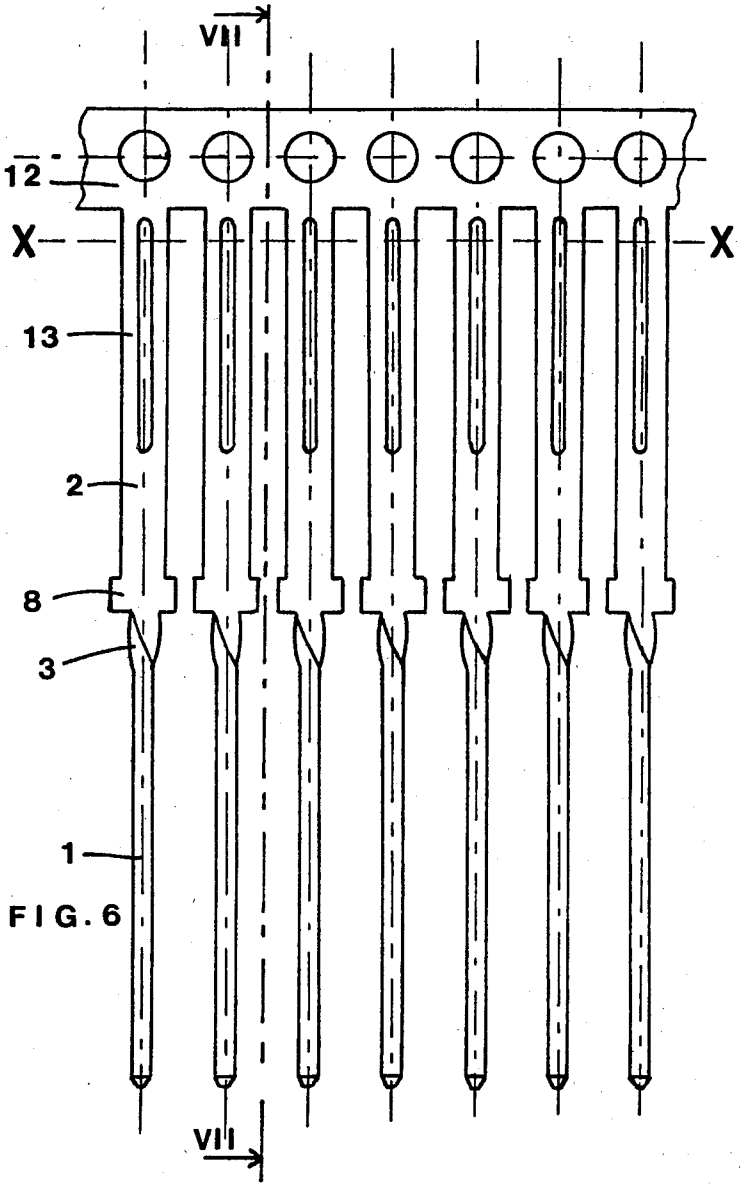
FIG. 6

CONTACT INSERTABLE IN A METALLIZED HOLE OF A PRINTED CIRCUIT CARD AND PROCESS

This application is a continuation of application Ser. No. 296,453, filed Aug. 26, 1981, now abandoned.

This invention relates to a contact insertable in a metallized hole of a printed circuit card, as well as processes of manufacture and of insertion of that contact in the metallized hole.

BACKGROUND

Contacts which can be forced into metallized holes of a printed circuit card are widely used at the present time to make solderless connections. They generally contain a first end portion designed to pass through the hole and project beyond one of the faces of the card, when the contact is in an insertion position, and a second end portion designed to project beyond the other face of the card. These two ends are joined by an intermediate portion, the function of which is ensure the electrical connection of the contact with the metallized interior surface of the hole and at the same time its mechanical retention in the hole.

A number of contacts include an indeformable prismatic intermediate portion having a rectangular or square section. On the insertion of such a contact, the edges of the intermediate portion, which extend parallel to the longitudinal axis of the contact or to its direction of insertion in the hole, dig themselves in the lined wall of the hole, thus forming gastight bonds which retard corrosion at the contact surfaces.

Those contacts present, however, a number of disadvantages. In particular, on their insertion into an opening which is too small, considerable forces develop in the axial direction which can tear away the lining or intermediate conductive layers, in the case of use of multi-layer circuits. On the other hand, if the size of the opening is too great, the axial retention of the contact through friction of the contact on the lining will be poor and may further deteriorate due to mechanical stresses (such as vibrations, or axial stresses exerted on either end of the contact or due to) or thermal stresses. It is clear that the use of this type of contact requires maintaining very strict dimensional tolerances on the printed circuit opening, which are difficult to obtain by electroplating methods. It is to be noted that when openings do not have perfectly round sections, the same contact will be retained better or worse according to whether the diagonals of its section correspond to a greater or lesser diameter of the opening measured in the direction of those diagonals. Furthermore, the radial stresses exerted by the median port on the lining are exerted in two diagonal directions, and this irregular distribution can lead to cracking of the lining.

There are still other contacts in which the intermediate portion is elastically deformable in a radial direction, which makes it possible, in theory, to reduce the dimensional tolerances of the lined holes which are to receive them. However, the gastightness of the contact surfaces is maintained only by providing absolutely optimal conditions of tolerance and use. It is also to be noted that the contact surface between the median part and the wall of the lining is never made over the entire height of that intermediate portion, which can lead to an unstable mechanical retention of the contact. Finally, the axial stresses and also the rotational stresses applied to the ends of the contact can be only imperfectly absorbed by the effect of friction on the wall of the lining.

The Invention

One object is to provide an insertable contact ensuring both excellent mechanical strength and highly satisfactory gastightness, yet presenting none of the disadvantages of the known contacts, while still allowing a relaxation of the dimensional tolerances attached to making the metallized hole of the printed circuit card.

Briefly, the intermediate portion of the insertable contact comprises a spiral structure. According to one particularly advantageous embodiment from the standpoint of manufacture of the contact as well as of its use, the intermediate portion has a rectangular cross-section, the vertices of which define the edges of a spiral structure, and the angle of rotation of which is 90°. The contact is preferably inserted in the metallized hole by exerting a longitudinal thrust on its second end portion in the direction of the first, the contact freely rotating during at least the phase of penetration of the intermediate portion into the hole. Under these conditions, the contact will penetrate the material of the hole lining in a spiral path, and will be in an inserted position which is shifted 90° from its initial position. Among the numerous advantages of this invention, the following are evident:

The contact is perfectly guided and maintained axially because the contact points are distributed over the whole periphery of the inner wall of the lining, on its entire height. This characteristic guarantees a firm achoring of the contact against bending stresses exerted on either end;

The quality of the electric contact and the retention of the piece are affected to a lesser extent by the iregularities of the hole and dimensional tolerances not being as tight for they no longer depend, as previously, on the dimensional precision of the hole in two sole directions;

The mechanical stresses in the lining of the hole are also distributed over the entire periphery the contact element bearing against and squeezing the metallized surface lining of the hole. By virtue of the sinusoidal shape of the edges in radial projection, the radial stresses can be absorbed by the slightly elastic material forming the printed circuit card. The card thus forms an elastic element without the electrical or mechanical properties of the contact being jeopardized;

The contact surface corresponding to the number of electrically active points and forming a tight bond is markedly increased due to the spiral structure;

Damage to the lining of the hole is lessened and its cracking is prevented so that it will remain electrically continuous;

The axial forces exerted on the first end portion, on formation of a wound connection or contraction of a winding are absorbed by the effect of friction;

By providing a spiral structure with a lefthanded pitch, the axial and twisting forces appearing on formation of a wound connection, which normally takes place clockwise, are partially counteracted and can be taken up by the surface of the opposite face of the printed circuit card by means of shoulders provided on the contact. This arrangement largely eliminates the effects of wear on the hole or other effects acting unfavorably on the quality of the bond.

DRAWINGS

FIG. 6 is a view in elevation of a series of contacts, according to the invention, in the course of manufacture;

FIG. 7 represents a section along line VII—VII of a contact of FIG. 6; and

FIG. 8 represents another embodiment of a contact according to the invention.

DETAILED DESCRIPTION

Figure 1:
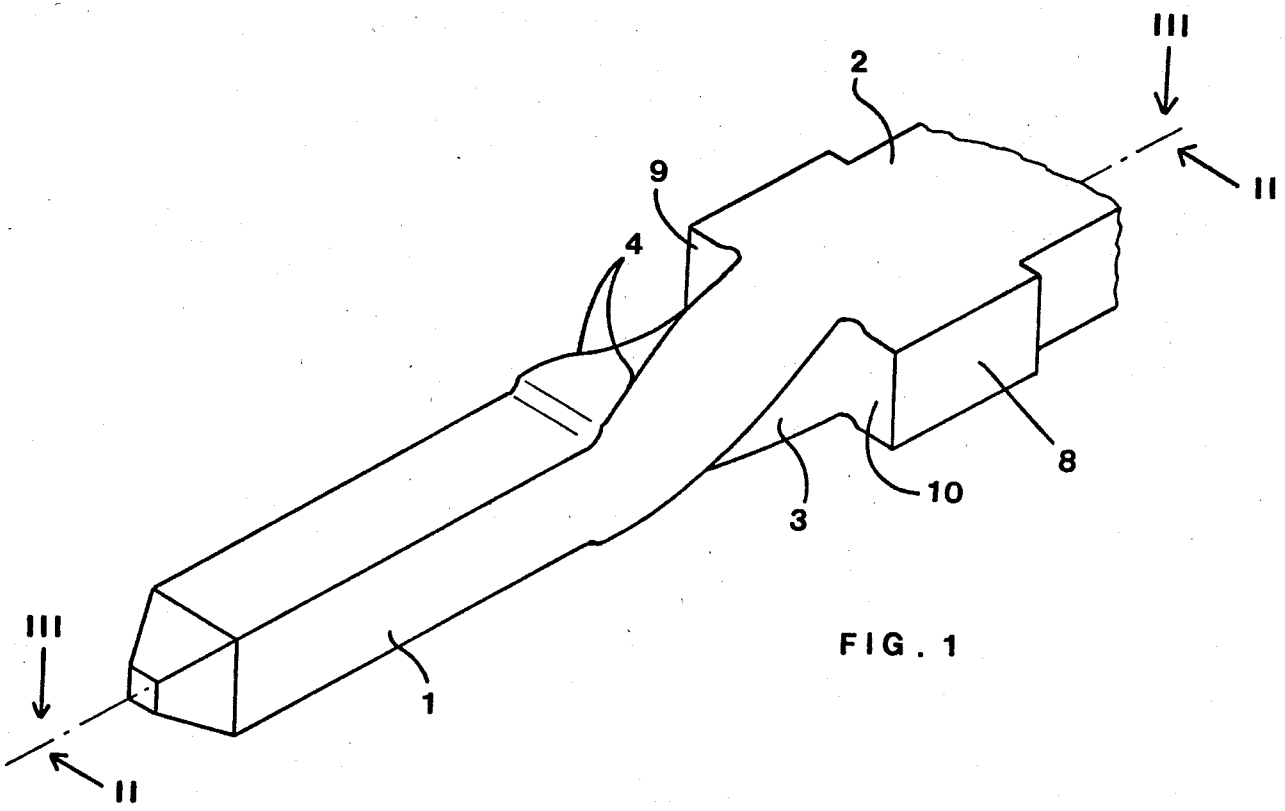
FIG. 1 is a partial view in perspective of an insertable contact according to the invention.
Figure 3:
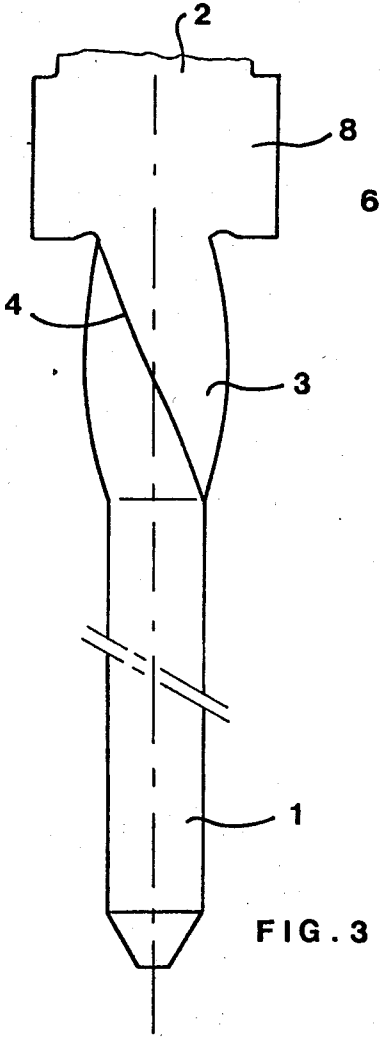
FIG. 3 is a view in elevation of the contact of FIG. 1, along lines III—III of FIG. 1.
Figure 2:
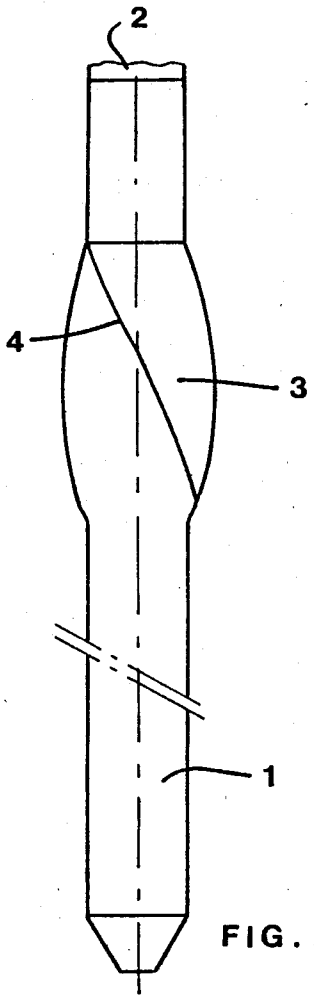
FIG. 2 is a view in elevation of the contact of FIG. 1, along lines II—II of that figure.

As can be best seen in FIGS. 1 to 3, the contact, according to one embodiment of the invention, contains a first end portion 1 of a generally square cross-section designed to project beyond one of the faces of printed circuit card, so as to be able to receive an electrical wire fastened by means of a wound or wrap connection. The second end portion 2, not shown on the drawing, is designed to project over the other face of the printed card and to facilitate the connection of a secondary printed card or of an electric wire or of any other device.

Figure 5:
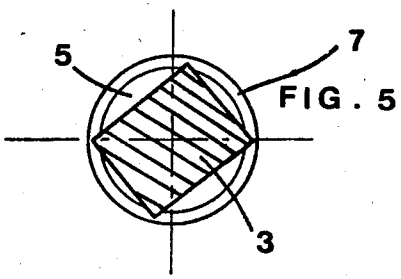
FIG. 5 is a sectional view along line V—V of the contact of FIG. 4.

The invention relates, in particular to the median part 3 of the contact. According to the invention, the median part 3 has a spiral structure. The section of median part 3 is polygonal, preferably rectangular (FIG. 5) (for example, square), and its vertices define the edges 4 of the spiral structure. In the case of square or otherwise rectangular section, the angle of rotation of the spiral is preferably 90°; that is, the pitch of the spiral corresponds to the length of the median part.

Figure 4:
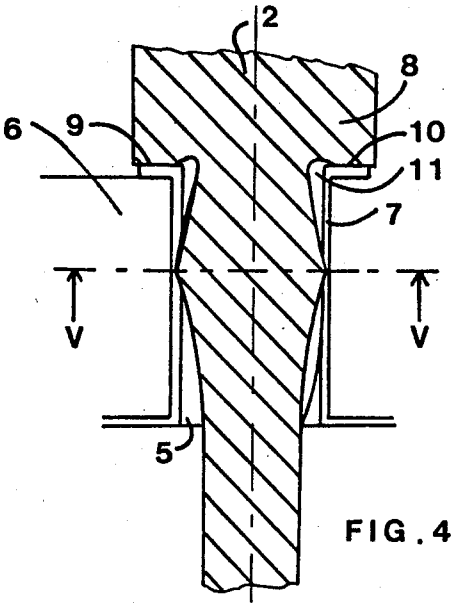
FIG. 4 is a sectional view of a contact according to the invention after insertion in a hole of a printed circuit card.

FIG. 4 represents the contact in an insertion position in a hole 5 of a printed circuit card 6 clad inside with a conductive lining 7. A shoulder 8 with at least two flat surfaces 9 and 10, perpendicular to longitudinal axis 11 of the contact, is provided at the junction of intermediate portion 3 and second end portion 2 in order to bear on the upper face of the printed circuit in the insertion position of the contact.

The contact is best set in place by simply exerting on its second end portion 2 a longitudinal thrust in the direction of its end portion 1 while keeping the contact freely rotating during at least the phase of penetration of the median part into the hole. The contact, on turning, then penetrates the wall of lining 7. Surfaces 9 and 10 then make it possible to set the axial position and, consequently, the angular orientation of the contact in the insertion position. Furthermore, those same surfaces 9 and 10 make it possible to transfer the stresses applied to end 1 directly to the upper face of card 6 when a wire is connected to end 1 by a wrap connection. Preferably, the pitch of the spiral structure is lefthand, while the winding connection is generally made clockwise. A groove 11 is formed at the junction of surfaces 9 and 10 of median part 3 in order to prevent any mis-positioning caused by irregularities of lining 7 at the entrance to hole 5.

To guarantee a correct connection of the same contact in holes of different depths, especially for multilayer circuits, it will be sufficient to provide that the length of intermediate portion 3 corresponds to the greatest depth of the holes capable of receiving it. The length of the diagonals of the section of that intermediate portion should, of course, be slightly greater than the average diameter of the opening defined by the walls of lining 7.

FIG. 6 shows, by way of example, a series of contacts of the present invention during manufacture. The cutting, bending and forming operations are carried out from a metal strip 12, which may comprise phosphorus-bronze or tin-bronze, the individual contacts of which can be separated only along a line X by the ultimate user of the contacts before their insertion in the printed circuit cards. The contacts shown on that figure, like the one on FIG. 7, contain a second end 2 forming an elastic fork 13 provided for the connection of printed cards, for example. The contact of FIG. 8 contains a second end, also forming a connecting wrap terminal so as to make a flat cable connector. The lining of the different zones of these contacts can be provided by the customary methods.

To make the intermediate portion 3, the manufacturing operations advantageously include a step in which a 90° twist is applied to one of the ends of the contact in relation to the other on the longitudinal axis of the contact, so as to impart the desired spiral configuration to the intermediate portion of the contact pin.

Although it has been described in connection with one particular embodiment of the intermediate portion, the invention is not at all limited to it. Rather, it lends itself to modifications and variations which will appear clear to those versed in the art.

In particular, other solutions according to the invention could, though less advantageous, be envisaged for the angular characteristics of the spiral structure as well as for the shape of its section or its process of manufacture.

We claim:

1. The combination of a printed circuit card (6) of a predetermined thickness having a hole (5) formed therein, said hole having a metallized contact surface layer (7) on its walls, with an elongated contact terminal pin element insertable in the hole, for making electrical connection with the metallized contact surface layer (7) of the hole and for mechanical attachment to the printed circuit card (6), wherein the terminal pin element comprises:

a first end portion (1) of polygonal cross-section and suitable for a wire-wrap connection dimensioned to pass through the hole (5) and project beyond one of the faces of the card (6) when the contact pin element is in an inserted position in the card;

a second end portion (2) of polygonal cross-section and suitable for a wire-wrap connection dimensioned to project beyond the other face of the card when the contact is in the inserted position;

an intermediate portion (3) of twisted polygonal cross-section and of a length corresponding about to the thickness of said card connecting the first and second end portions, the surfaces of said intermediate portion having edges defining twisted corners;

said end portions and intermediate portion being substantially aligned on a common axis which is also the axis of twist of said intermediate portion, whereby said terminal element is inserted by only axial pressure on said second end portion while permitting free rotation of the pin element to self-twist the pin element into the hole, and wherein said intermediate portion, when inserted in said hole, engages by said twisted corners the metallized interior surface layer (7) of the hole and at the same time ensures mechanical retention of the terminal pin element in the hole, by deformation of said metallized contact surface layer in a spiral path which leaves said surface layer electrically continuous and forms a gastight connection preventing corrosion of the contact surface of said metallized layer which is in engagement with said pin element.

2. Combination according to claim 1, further comprising stop means on said second end portion (2) at the junction thereof with said intermediate portion of said terminal pin, for preventing said second end portion from being insertable in said hole by further movement in the same direction after insertion of said first end portion followed by said intermediate portion.

3. The combination of a printed circuit card (6) of a predetermined thickness having a hole (5) formed therein, said hole including a metallized contact surface layer (7) on its walls, with an elongated contact terminal pin element of rectangular cross section throughout its length, insertable in the hole for making electrical connection with the metallized contact surface (7) in the hole and for mechanical attachment to the printed circuit card (6);

wherein the terminal pin element comprises:

a first end portion (1) dimensioned to pass through the hole (5) and project beyond one of the faces of the card (6) when the contact is in an inserted position in the card;

a second end portion (2) dimensioned to project beyond the other face of the card when the contact pin element is in the inserted position;

an intermediate portion (3) of twisted rectangular cross-section and of a length corresponding about to the thickness of said card, connecting the first and second portions, the surfaces of said intermediate portion having edges defining twisted corners;

said end portions and said intermediate portion being substantially aligned on a common axis which is also the axis of twist of said intermediate portion, whereby said terminal element is inserted by only axial pressure on said second end portion while permitting free rotation of the pin element to self-twist the pin element into the hole, and wherein said intermediate portion, when inserted in said hole, engages by said twisted corners the metallized interior surface layer (7) of the hole and at the same time ensures mechanical retention of the terminal pin element in the hole, by deformation of said metallized contact surface layer in a spiral path which leaves said surface layer electrically continuous and forms a gastight connection preventing corrosion of the contact surface of said metallized layer which is in engagement with said pin element.

4. Combination according to claim 3, wherein the angle of rotation of the spiral structure is about 90°.

5. Combination according to claim 3, wherein the spiral structure has a left hand pitch.

6. Combination according to claim 3, further comprising stop means of a configuration broadening said second end portion for a brief length thereof immediately adjacent to said intermediate portion (3) of said contact pin element, for preventing said second end portion from being insertable in said hole by further movement in the same direction after insertion of said first end portion followed by said intermediate portion.

7. Combination according to claim 6, wherein said stop means comprise shoulders (8) formed with flat surfaces (9, 10) perpendicular to the longitudinal axis of the contact terminal pin element.

8. Combination according to claim 7, further including a groove (11) formed at the junction between the intermediate portion (3) and the flat surfaces (9, 10) to provide for relief at inner portions of the surfaces.

9. A method of inserting a contact terminal pin element into a hole (5) of a printed circuit card (6), wherein the hole (5) has a metallized surface (7), and said contact terminal pin element comprises an elongated metal contact terminal pin having a first end portion of polygonal cross-section and suitable for a wire-wrap connection (1) dimensioned to freely pass through the hole (5) and project beyond one the faces of the card (6) when the contact is in an inserted position, a second end portion of polygonal cross-section and suitable for a wire-wrap connection (2) dimensioned to project beyond the other face of the card when the contact is in the inserted position an intermediate portion (3) of twisted polygonal cross-section and of a length corresponding about to the thickness of the card, connecting the first and second end portions, in which the surfaces of the intermediate portion have edges defining corners twisted about a longitudinal axis of the pin element for a limited angular extent to form a spiral structure running between said first and second end portions, said method comprising the steps of aligning the first end portion with the hole, and axially inserting the first end portion through the hole and exerting only axial pressure on the second end portion while permitting free rotation of the contact terminal pin element to self-twist the element into the hole by said limited angular extent to seat the twisted intermediate portion defining the spiral structure within the hole (5), the corners and adjacent portions of the spiral structure, during insertion engaging the metallized interior surface of the hole under the axial insertion pressure while permitting free rotation of the contact terminal pin element, ensuring mechanical retention of the terminal pin element in the hole and electrical connection, by deforming said metallized interior surface in a spiral path while leaving it electrically continuous and forming a gastight corrosion-resistant connection, and transferring said axial pressure from said intermediate portion of contact pin element to said card when said intermediate portion has fully entered into said hole, to stop further advance of said pin before said axial pressure is discontinued.

10. The method according to claim 9, wherein the limited angular extent, or twist of said element is about 90°, and the insertion step includes permitting free rotation of said element for said angular extent of about 90°.

11. Method according to claim 9, wherein said elongated metal contact terminal pin is of rectangular cross section throughout its length.

12. Method according to claim 11, wherein the limited angular extent of twist of said element is about 90°, and the insertion step includes permitting free rotation of said element for said angular extent of about 90°.

13. Method according to claim 9 wherein the step of transferring said axial pressure to said card is performed by means of a broader section of said second end portion of said pin element adjacent to said intermediate portion thereof by continuing the application of said axial pressure until said broader section comes into abutment against said card.

14. Method according to claim 13, wherein said broadened section of contact terminal pin element includes shoulders (8) formed with flat surfaces (9, 10) perpendicular to the longitudinal axis of the contact terminal pin element, and positioned at the junction of said intermediate part and the second end portion (2);

and wherein said step of exerting axzial pressure comprises exerting axial pressure on the contact terminal pin element until said flat surfaces are seated against a surface of the printed circuit card.

* * * * *

UNITED STATES PATENT AND TRADEMARK OFFICE

CERTIFICATE OF CORRECTION

PATENT NO. : 4,557,539

DATED : December 10, 1985

INVENTOR(S) : Harry ZUST and Sigi BURGI

It is certified that error appears in the above-identified patent and that said Letters Patent is hereby corrected as shown below:

Please add, in the heading, the following:

--[30] Foreign Application Priority Data:
September 5, 1980 [CH] Switzerland 6679/80--.

Signed and Sealed this

*Twenty-ninth* Day of *April 1986*

[SEAL]

*Attest:*

DONALD J. QUIGG

*Attesting Officer*

*Commissioner of Patents and Trademarks*